United States Patent [19]

Davis

[11] Patent Number: 4,766,807

[45] Date of Patent: Aug. 30, 1988

[54] DAMPER BLADE SEAL

[75] Inventor: James A. Davis, Franklin, Tenn.

[73] Assignee: American Standard Inc., New York, N.Y.

[21] Appl. No.: 90,191

[22] Filed: Aug. 27, 1987

[51] Int. Cl.[4] ..... F24F 13/10

[52] U.S. Cl. ..... 98/121.2; 98/110; 137/601

[58] Field of Search ..... 49/91; 98/110, 121.2; 137/601

[56] References Cited

U.S. PATENT DOCUMENTS

| | | | |
|---|---|---|---|
| 3,046,619 | 7/1962 | Shustron | 49/91 X |
| 3,187,768 | 6/1965 | Waterfill | 137/3 |
| 3,606,245 | 9/1971 | Reichon et al. | 137/601 X |
| 3,894,481 | 7/1975 | Alley | 98/121.2 |
| 4,193,605 | 3/1980 | Josephson | 98/1 |
| 4,469,132 | 9/1984 | Redington | 98/110 X |
| 4,541,328 | 9/1985 | Brzezinski et al. | 98/121.2 |

*Primary Examiner*—Harold Joyce

*Attorney, Agent, or Firm*—William J. Beres; David L. Polsley; Robert J. Harter

[57] ABSTRACT

A rectangular damper blade rotates about its longitudinal center line between an open and closed position to control the airflow entering an enclosure. Two longitudinal edges of the damper blade become positioned between two inlet edges of the enclosure as the blade rotates to the closed position. The blade is associated with two longitudinal seals. One seal is attached directly to one of the blade's longitudinal edges and provides wiping contact against one of the inlet edges. The other seal is attached to the other inlet edge and provides wiping contact against the blade's other longitudinal edge. Both seals have similar cross-sections to facilitate their interchangeability. And both seals include a flexible lip that extends upstream and perpendicular to the blade to enhance the sealing force and to minimize wiping friction. In the presence of an air pressure differential across the damper blade, the seals urge the blade to the closed position, and when closed, exert a radial sealing force generally parallel to the blade. The configuration of the seals provides a damper that is tolerant of misalignment which makes it suitable for direct drive actuation.

12 Claims, 3 Drawing Sheets

DAMPER BLADE SEAL

TECHNICAL FIELD

The subject invention generally pertains to rotatable damper blades and more specifically to the seals associated with such blades.

BACKGROUND OF THE INVENTION

Rectangular damper blades generally open and close by rotating about their longitudinal center line. Such blades are usually positioned within an appropriate rectangular inlet opening, and blade seals are often situated between the inlet opening and the blade's longitudinal edges.

In designing the specific geometry and mounting configuration of the blade seals, several interrelated factors need to be taken into account. These factors include sealing ability, closing force, friction, blade twist, drive requirement, and tolerance of misalignment and overshoot. Sealing ability is generally a function of the closing force of the blade and/or the radial interference at the seal between the blade and the inlet opening. Increasing the closing force, however, often requires the use of relatively large drives and sturdy blades that resist twisting. Likewise, increasing radial interference increases friction which also requires larger drives and sturdier blades. Overshoot is the distance the blade attempts to travel after reaching its intended closed position. Some seal designs have an abrupt closing point that provide little or no tolerance to blade twist or overshoot, making them susceptible to both leakage and damage. And light weight blades driven by small drive motors are usually sensitive to overshoot or allow only the use of light weight seals that provide inadequate sealing.

Previous blade designs typically address some of the above problems while compromising on others. Consequently, a need exists for a single, well designed damper blade that addresses all of the above problems.

Therefore, an object of the invention is to provide a pair of damper blade seals whose sealing force increases in response to the pressure differential across the damper blade.

Another object is to provide a seal whose sealing force is generally aligned with the damper blade to minimize the bending moment on the blade.

Another object is to provide a seal that offers a sliding contact as the blade closes, thereby allowing for blade twist and overshoot.

Yet another object is to provide a pair of generally interchangeable seals, one of which is attached directly to an edge of the blade and the other being attached to a similar edge next to the blade.

A further object is to provide a pair of seals that augment the closing force of the blade in the presence of a pressure differential across the blade.

A still further object is to provide a direct drive damper blade having sliding contact blade seals for eliminating the need for accurate blade alignment and linkage adjustment.

These and other objects of the invention will be apparent from the description of the preferred embodiment which follows hereinbelow and the attached drawings.

SUMMARY OF THE INVENTION

A generally planar damper blade is rotatable about its longitudinal axis and includes two longitudinal edges that become positioned between two adjacent edges as the blade rotates to a closed position. The blade is associated with two seals, one being attached to one of the blade's longitudinal edges and providing a wiping contact against one of the two adjacent edges, and the other seal being attached to the other adjacent edge and providing a wiping contact against the blade's other longitudinal edge. Both of the seals have similar cross-sections to facilitate their interchangeability, and both include a flexible lip that extends generally upstream and generally perpendicular to the blade. In the presence of an air pressure differential across the damper blade, the seals urge the blade to the closed position, and when closed, exert a radial sealing force generally parallel to the blade.

DESCRIPTION OF THE PREFERRED EMBODIMENT

Figure 2:
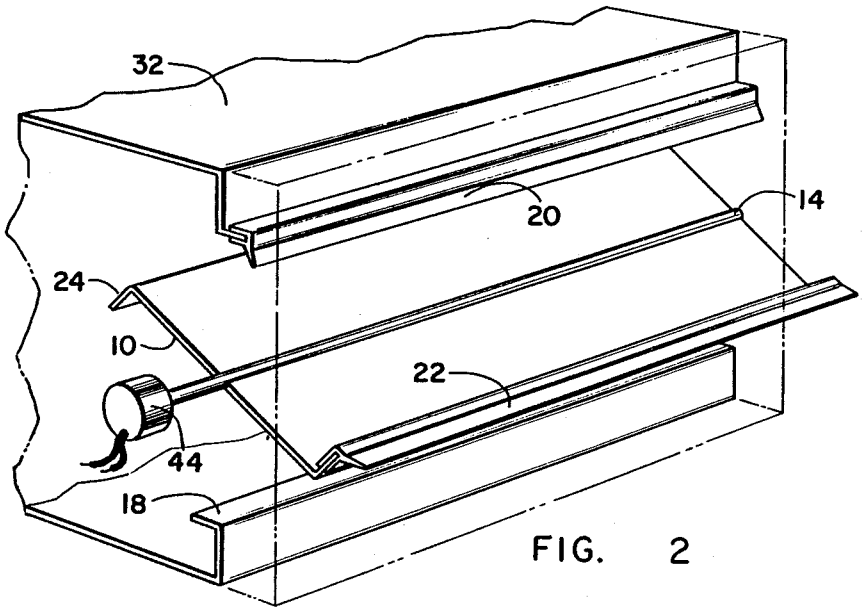
FIG. 2 is a perspective view of FIG. 1.
Figure 1:
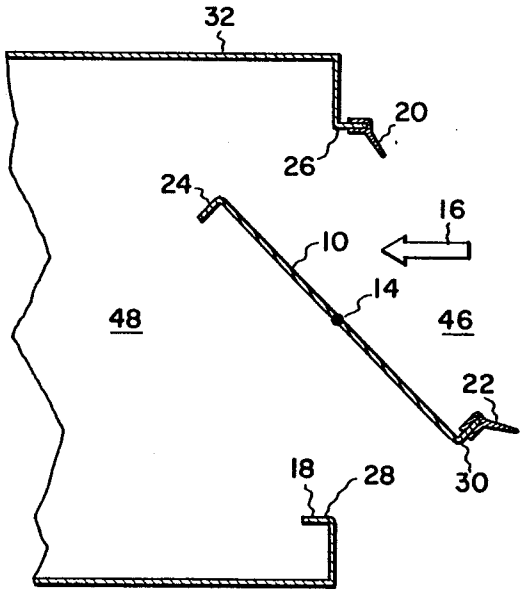
FIG. 1 shows the preferred embodiment of the invention with the damper blade in an open position.
Figure 4:
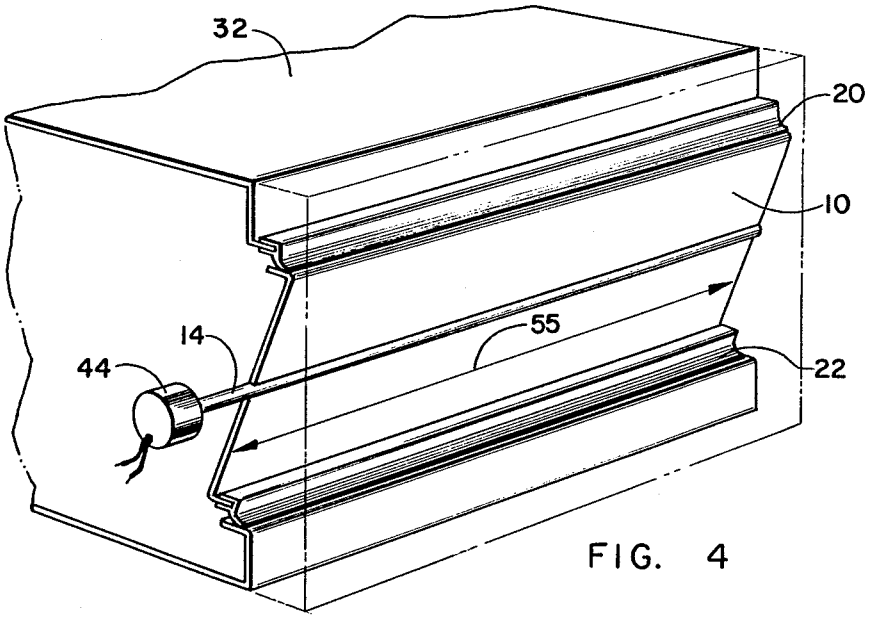
FIG. 4 is a perspective view of FIG. 3.
Figure 3:
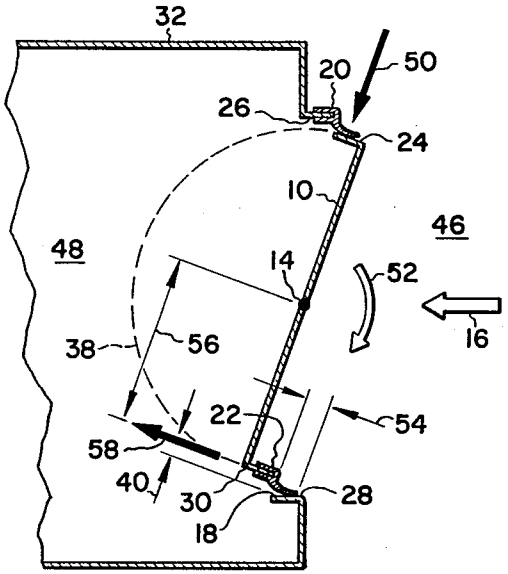
FIG. 3 shows the damper blade of FIG. 1 in the closed position.
Figure 6:
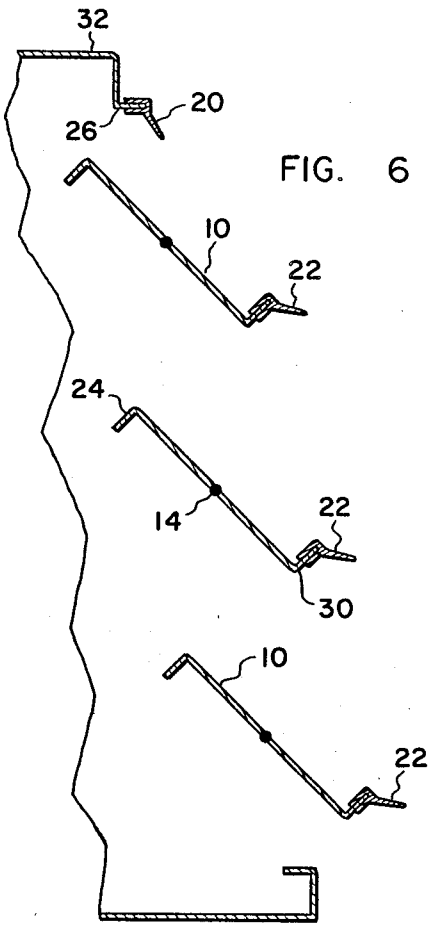
FIG. 6 shows an embodiment of the invention that includes multiple blades.

FIGS. 1–4 illustrate the preferred embodiment of the invention with FIGS. 1 and 2 showing a rotatable damper blade 10 in an open position, and FIGS. 3 and 4 showing blade 10 in a closed position. Damper blade 10 moves between an open and closed position by rotating about its longitudinal axis 14. In the preferred embodiment, axis 14 happens to be the blade's longitudinal center line. As an alternative, however, any other rotational axis of the blade could also be used.

In the closed position, damper blade 10 substantially blocks the airflow of a current of air 16 through enclosure inlet 18. Flexible polymeric seals 20 and 22 further assist in blocking the airflow by preventing air from leaking past the damper between an outer longitudinal edge 24 of blade 10 and an adjacent inlet edge 26, and also between another longitudinal edge 30 and another adjacent inlet edge 28. Seal 22 extends from blade edge 30, and seal 20 extends from an inlet edge 26 of enclosure 32. Although in the preferred embodiment edge 26 partially defines an inlet opening through enclosure 32, in other variations of the invention, edge 26 could be a part of any air handling device such as a discharge air duct or even another damper blade which will be further described below. In addition, seals 20 and 22 could be made of any flexible material, such as thin sheet metal, and could even be an integral part of the blade itself or an integral part of edge 26.

Figure 5:
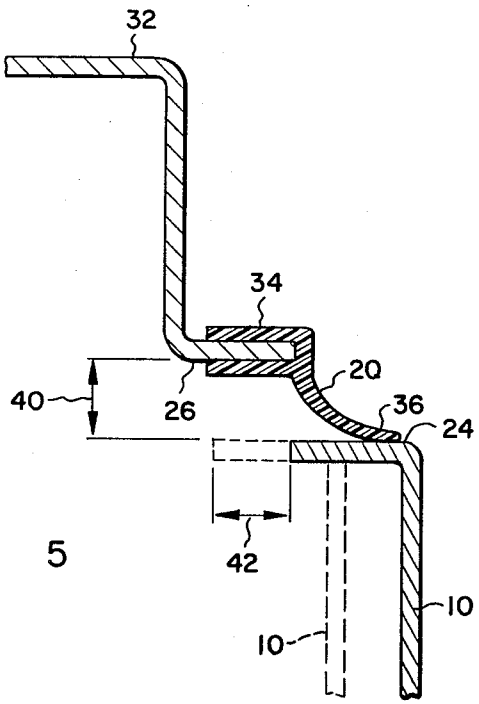
FIG. 5 is an enlarged view of the seal shown in FIGS. 1–4.

Referring to FIG. 5, a base portion 34 of seals 20 and 22 have a U-shape profile which makes them readily mountable by using any one of a variety of fasteners, by gluing, or even by means of an interference or snap-on fit. The similarity of edges 26 and 30 allows seals 20 and 22 to have similar cross-sections, making them mountable on either blade edge 30 or inlet edge 26, i.e., they are generally interchangeable except in some cases their length and fastening means may differ somewhat.

Seals 20 and 22 include a flexible lip 36 that is in sliding contact to provide a wiping action with an adjacent edge such as edge 24 or 28. In the closed position, the lips flex to extend generally perpendicular to blade 10 and tangent to cylinder 38 which is an imaginary cylinder generated by edges 24 and 30 as blade 10 rotates about its axis 14. The generally tangent configuration of the lips reduces the wiping friction along edges 24 and 28 which minimizes the blade's tendency to twist. The tangential configuration of the lips in addition to its flexibility allows for variation in radial clearance 40 without exerting undue radial compressive forces against blade 10. Radial clearance 40 is made possible by the distance between edges 24 and 30 being less than the distance between edges 26 and 28. The reduced friction and tolerance of misalignment facilitate the use of a direct drive motor 44 (see FIG. 2) which eliminates the need for adjustable drive linkages and careful alignment procedures.

When damper blade 10 is closed, as shown in FIG. 3, the flexible lips 36 both point generally upstream 46. This allows an air pressure differential (upstream 46 minus downstream 48) across blade 10 to increase both the sealing force 50 and closing moment 52. The sealing force 50 is the force applied by the seals against their sealing edges 24 and 28 under the influence of the pressure differential. The sealing force 50 approximately equals the product of the pressure differential times half the seal width 54 times the seal length 55. Closing moment 52 is what urges the damper to close in response to the pressure differential across the blade. In the closed position, the closing moment approximately equals a closing force 58 times a moment arm 56, with the closing force 58 being equal to the radial clearance 40 times the seal length 55 times the pressure differential, and the moment arm 56 being the perpendicular distance between closing force 58 and axis 14.

Figure 7:
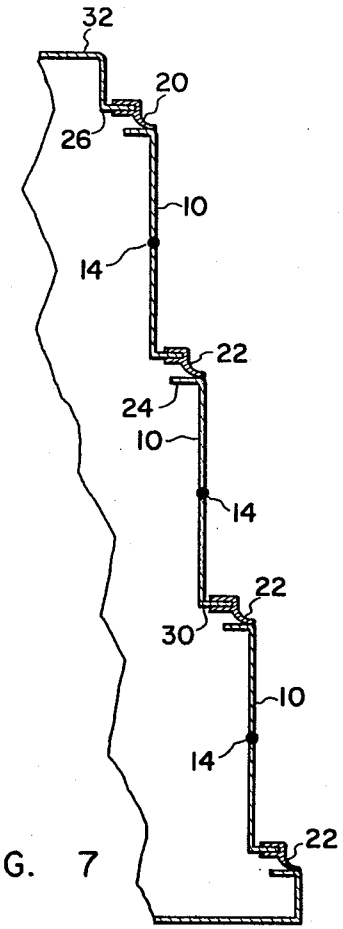
FIG. 7 shows the damper assembly of FIG. 6 in the closed position.

FIGS. 7 and 8 illustrate a multiple blade configuration that employs the basic principles of the preferred embodiment. Each blade 10 is associated with two seals, one being attached to the lower edge 30 of the blade, and the other being attached to an edge that is adjacent to upper edge 24 when the blade is closed, i.e., attached to edge 26 or edge 30 of an adjacent blade. These and other modifications to the preferred embodiment, as disclosed hereinabove, will be readily apparent to those skilled in the art, and it should be understood that while the present invention has been described with respect to the preferred embodiment, such modifications lie within the scope of the present invention as defined in the claims which follow:

I claim:

1. A damper assembly comprising:

a. generally rectangular solid damper blade adapted to divide a current of air between an upstream and downstream side, said blade being rotatable about its longitudinal center line between an open and a closed position, said damper blade having two generally similar flat longitudinal edges that generally describe a cylinder as said blade is rotated, said flat longitudinal edges extend generally perpendicular to said generally planar damper blade;

b. a first seal attached to one of said longitudinal edges and including a flexible lip extending generally upstream and sealing in sliding contact against a first adjacent edge to provide a wiping action in a direction generally tangent to said cylinder as said damper blade closes and to urge said damper blade to said closed position under the impetus of a pressure differential between said upstream and downstream side; and c. a second seal, substantially similar to said first seal, attached to a second edge adjacent to an other longitudinal edge of said blade, said second seal including a flexible lip extending generally upstream and sealing in sliding contact against said other longitudinal edge of said blade to provide a wiping action in a direction generally tangent to said cylinder as said damper blade closes.

2. The damper assembly as recited in claim 1, wherein said first adjacent edge partially defines an inlet opening through an air handling enclosure.

3. The damper assembly as recited in claim 1, wherein said second adjacent edge partially defines an inlet opening through an air handling enclosure.

4. The damper assembly as recited in claim 1, wherein said second adjacent edge is disposed on another damper blade.

5. The damper assembly as recited in claim 1, wherein the distance between the blade's two longitudinal edges is less than the distance between said first and second adjacent edges when said damper blade is in said closed position.

6. The damper assembly as recited in claim 1, wherein said seals exert a radial force generally toward said longitudinal axis when said damper blade is in said closed position.

7. The damper assembly as recited in claim 1, wherein said damper blade is rotated by a direct drive motor.

8. A damper assembly comprising:

a. a generally rectangular and generally planar damper blade adapted to divide a current of air between an upstream and a downstream side, said blade being rotatable about a longitudinal axis between an open and closed position and including two generally similar flat longitudinal blade edges that generally describe a cylinder as said blade is rotated, said flat longitudinal edges extend generally perpendicular to said generally planar damper blade, said longitudinal blade edges being positioned substantially between and adjacent to a first and second edge when said damper blade is in said closed position;

b. a first seal attached to one of said longitudinal blade edges such that said first seal tends to urge said damper blade to said closed position under the impetus of a pressure differential between said upstream and downstream side, said first seal including a first flexible lip extending toward said upstream side and sealing in sliding contact against said first edge to provide a wiping action in a direction generally tangent to said cylinder as said damper blade comes to rest at said closed position and to exert a radial sealing force against said first edge in a direction generally parallel to said generally planar damper blade when said blade is closed; and c. a second seal attached to said second edge and having generally the same cross-sectional profile as said first seal, said second seal including a second flexible lip extending generally upstream in sliding contact against an other longitudinal edge of said blade to provide a wiping action in a direction generally tangent to said cylinder as said damper blade comes to rest at said closed position and to exert a radial sealing force against said other longitudinal edge in a direction generally parallel to said generally planar damper blade when said blade is closed.

9. The damper assembly as recited in claim 8, wherein said first and second edges partially define an inlet opening through an air handling enclosure.

10. The damper assembly as recited in claim 8, wherein said first and second edges are disposed on other damper blades that are adjacent to said damper blade.

11. The damper assembly as recited in claim 8, wherein said damper blade is rotated by a direct drive motor.

12. The damper assembly as recited in claim 8, wherein said longitudinal axis is the longitudinal centerline of said damper blade.

* * * * *